United States Patent [19]

Ishibashi

[11] Patent Number: 4,635,854

[45] Date of Patent: Jan. 13, 1987

[54] FUEL INJECTION VALVE FOR INTERNAL COMBUSTION ENGINES

[75] Inventor: Toru Ishibashi, Higashimatsuyama, Japan

[73] Assignee: Diesel Kiki Co., Ltd., Tokyo, Japan

[21] Appl. No.: 729,557

[22] Filed: May 2, 1985

[30] Foreign Application Priority Data

May 10, 1984 [JP] Japan ..... 59-93243

[51] Int. Cl.[4] ..... F02M 47/00

[52] U.S. Cl. ..... 239/533.8; 239/533.9

[58] Field of Search ..... 239/533.3–533.12

[56] References Cited

U.S. PATENT DOCUMENTS

| | | | |
|---|---|---|---|
| 4,215,821 | 8/1980 | Eblen | 239/533.4 |
| 4,269,360 | 5/1981 | Kopse | 239/533.8 |
| 4,285,471 | 8/1981 | Eblen et al. | 239/533.4 |
| 4,403,740 | 9/1983 | Eblen et al. | 239/533.8 |

FOREIGN PATENT DOCUMENTS

| | | | |
|---|---|---|---|
| 2726300 | 12/1978 | Fed. Rep. of Germany | 239/533.8 |
| 2093117 | 8/1982 | United Kingdom | 239/533.9 |

*Primary Examiner*—Jeffrey V. Nase
*Assistant Examiner*—Michael J. Forman
*Attorney, Agent, or Firm*—Frishauf, Holtz, Goodman & Woodward

[57] ABSTRACT

A central plunger is disposed in the nozzle holder for displacement in unison with the nozzle needle through a whole lifting stroke thereof. The central plunger has an end remote from the nozzle needle slidably fitted in an axial bore formed in the nozzle holder and provided with restriction means. The axial bore is communicated with a fuel inlet port formed in the nozzle holder and connected to an injection pipe extending from the fuel injection pump. The nozzle needle is lifted in unison with the central plunger against increased fuel pressure within the axial bore via the central plunger in addition to the urging force of the nozzle spring, so that it gradually lifts, resulting in reduced combustion noise of the engine, as well as a high valve opening pressure.

5 Claims, 2 Drawing Figures

FUEL INJECTION VALVE FOR INTERNAL COMBUSTION ENGINES

BACKGROUND OF THE INVENTION

This invention relates to a fuel injection valve for internal combustion engines, particularly for diesel engines.

In a conventional fuel injection valve, during the injection stroke there occurs an increase in the volume of the effective fuel space within the injection pipe and the fuel injection valve, which extends between the fuel injection pump and the nozzle holes, due to lifting of the nozzle needle. This volumetric increase causes a temporary drop in the pressure within the pressure chamber, which in turn affects the injection rate waveform. That is, as indicated by the broken line in FIG. 2, a drop occurs in the lifting speed shortly after the start of injection to form a shoulder a in the waveform, and thereafter the rise speed recovers. This curve resembles the leading edge of an injection rate waveform obtained by a throttle nozzle. However, while in the throttle nozzle the flow rate through the nozzle holes can be throttled along a stable curve at the beginning of lifting of the nozzle needle, in the case of a hole nozzle, the length of the shoulder a is not constant since it can easily be affected by changes in the injection pipe pressure, making it difficult to control the leading edge to a desired definite shape, resulting in unstableness of the injection quantity. Also at the termination of fuel injection, there occurs a decrease in the volume of the effective fuel space due to descending of the nozzle needle to its seated position by the force of the nozzle spring against the force of the pressure within the pressure chamber, which causes a temporary rise in the pressure within the pressure chamber. As a consequence, as shown by the broken line in FIG. 2, the descending speed temporarily drops shortly before the termination of injection. This results in unnecessary injection of fuel immediately before the termination of injection, badly affecting the emission characteristics of the engine.

In order to overcome such disadvantages, the present applicant has previously proposed in U.S. Ser. No. 677,879 filed Dec. 4, 1984, now abandoned a fuel injection valve for an internal combustion engine, which comprises a nozzle holder having a fuel inlet port formed therein and connected to an injection pipe extending from a fuel injection pump, a nozzle body supported by the nozzle holder and having at least one nozzle hole and a pressure chamber formed therein at an end thereof remote from the nozzle holder, the pressure chamber being more remote from the injection pipe than the fuel inlet port, fuel passage means formed in the nozzle holder and the nozzle body and extending between the fuel inlet port and the pressure chamber, a nozzle needle mounted within the nozzle body and liftable and returnable to open and close the nozzle hole, respectively, in response to an increase and a decrease in the pressure of fuel supplied into the pressure chamber, nozzle spring means urging the nozzle needle in a direction of closing the nozzle hole, and a central plunger disposed in the nozzle holder for displacement in unison with the nozzle needle through a whole lifting stroke thereof as well as through a whole returning stroke thereof. The central plunger has an end face remote from the nozzle needle disposed to receive pressure within the injection pipe through the fuel inlet port, to thereby impart an urging force to the nozzle needle in the direction of closing the nozzle hole.

In the proposed fuel injection valve, immediately upon the start of the injection, the central plunger lifts in unison with the nozzle needle in permanent contact therewith to move into the fuel inlet port to cancel an increase in the volume of the effective fuel space which would otherwise be caused by lifting of the nozzle needle, thereby obtaining an injection rate waveform with a sharp leading edge as shown by the solid line in FIG. 2. Further, at the termination of the injection, the central plunger immediately moves back in unison with the descending nozzle needle to recede from the fuel inlet port to cancel a decrease in the volume of the effective fuel space which would otherwise be caused by descending of the nozzle needle, thereby obtaining a sharply cut trailing edge of the waveform as shown by the solid line in FIG. 2. Therefore, the proposed fuel injection valve can achieve an ideal injection rate waveform and permits precise adjustment of the waveform so as to obtain an accurate injection quantity.

However, according to the above proposed fuel injection valve which is constructed such that the nozzle needle sharply lifts and sharply descends, the injection rate is high at the start of the injection due to sharp lifting action of the nozzle needle, and accordingly, the throttling period is short. This is disadvantageous in reducing the combustion noise of the engine.

SUMMARY OF THE INVENTION

It is the object of the invention to provide a fuel injection valve for internal combustion engines, which is capable of maintaining the fuel injection rate at a small value and accordingly obtaining a sufficient throttling period at the start of the injection, as well as capable of obtaining a sharply cut trailing edge of the injection rate waveform at the termination of the injection, to thereby contribute to improving the emission characteristics of the engine.

The present invention provides a fuel injection valve for an internal combustion engine, which comprises a nozzle holder having a fuel inlet port formed therein and connected to an injection pipe extending from a fuel injection pump, a nozzle body supported by the nozzle holder and having at least one nozzle hole and a pressure chamber formed therein at an end thereof remote from the nozzle holder, the pressure chamber being remoter from the injection pipe than the fuel inlet port, fuel passage means formed in the nozzle holder and the nozzle body and extending between the fuel inlet port and the pressure chamber, a nozzle needle mounted within the nozzle body and liftable and returnable to open and close the nozzle hole, respectively, in response to an increase and a decrease in the pressure of fuel supplied into the pressure chamber, nozzle spring means urging the nozzle needle in a direction of closing the nozzle hole, and a central plunger disposed in the nozzle holder for displacement in unison with the nozzle needle through a whole lifting stroke thereof, the central plunger having one end remote from the nozzle needle, said one end having an end face thereof disposed to receive pressure from the injection pipe through the fuel inlet port to thereby impart an urging force to the nozzle needle in the direction of closing the nozzle hole. The nozzle body has an axial bore formed therein and communicating with the fuel inlet port, and in which is slidably received the one end of the central plunger remote from the nozzle needle.

The fuel injection valve according to the invention is characterized in that restriction means is provided in the above axial bore at a location between the fuel inlet port and the one end of the central plunger. The restriction means at least acts to restrict flowing of fuel within the axial bore therefrom to the fuel inlet port as the central plunger lifts in unison with the nozzle needle, whereby the nozzle needle gradually lifts.

The above and other objects, features and advantages of the invention will be more apparent from the ensuing detailed description taken in conjunction with the accompanying drawings.

DETAILED DESCRIPTION

The invention will now be described in detail with reference to the drawings.

Figure 1:
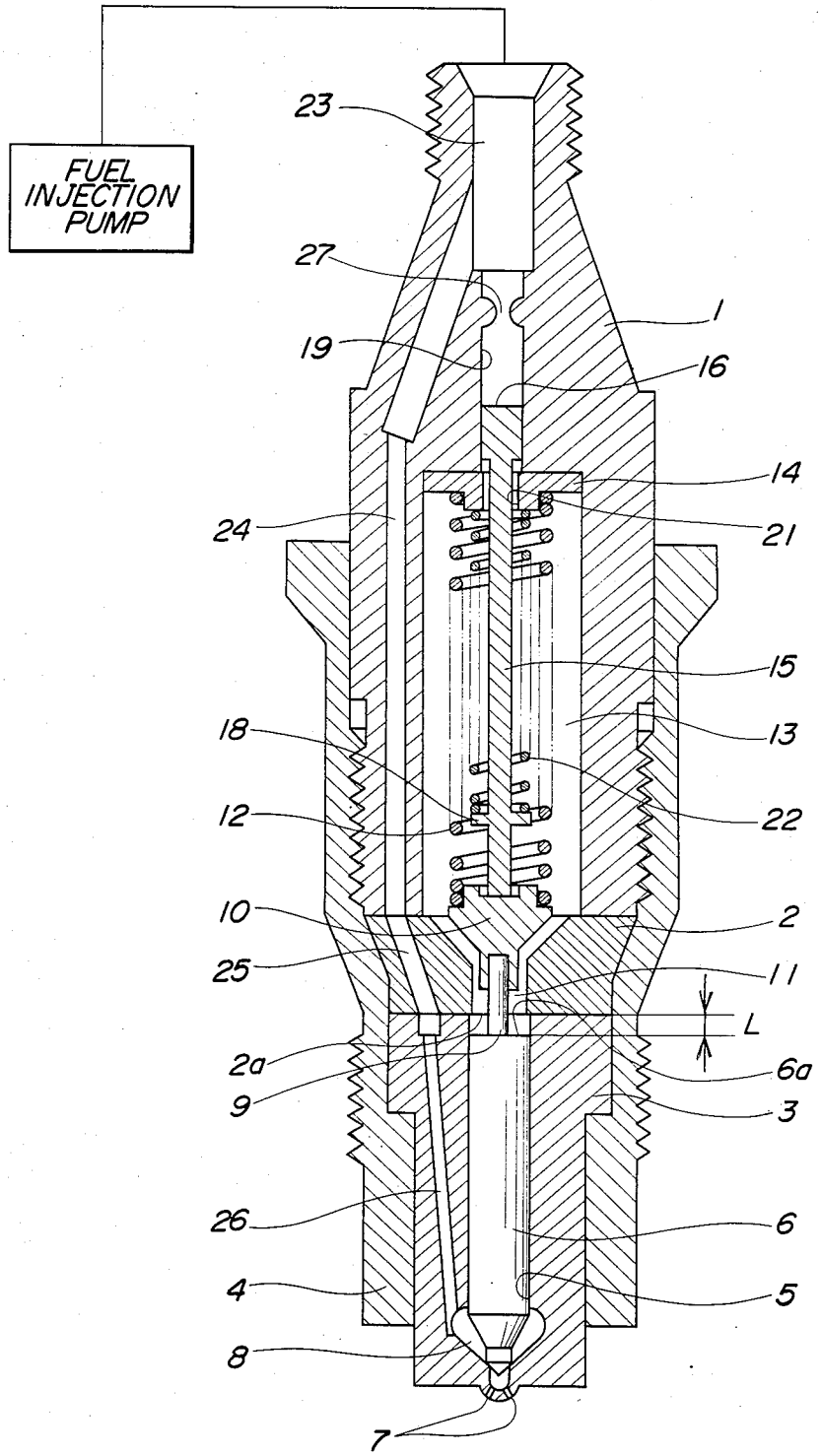
FIG. 1 is a longitudinal sectional view of a fuel injection valve according to an embodiment of the invention.

Referring first to FIG. 1, there is illustrated an embodiment of the invention, which is applied to a fuel injection valve having a hole nozzle. In FIG. 1, reference numeral 1 designates a nozzle holder, and 3 a nozzle body which is supported by a lower end of the nozzle holder 1 through a distance piece 2 interposed therebetween, by means of a retaining nut 4 threadedly fitted on the nozzle holder 1. The nozzle body 3 has an axial bore 5 formed therein along its axis, in which is slidably fitted a nozzle needle 6 for movement through a predetermined stroke. The nozzle body 3 is further formed therein with a plurality of nozzle holes 7 at the tip and a pressure chamber 8 at a location between the nozzle holes 7 and the axial bore 5 in communication with them. The nozzle needle 6 is liftable in response to the pressure of fuel supplied into the pressure chamber 8. The nozzle needle 6 carries a pin 9 planted on an upper end face thereof, to which is coupled a movable spring seat 10 located in an axial through hole 11 formed in the distance piece 2 along its axis. The nozzle holder 1 has a spring chamber 13 axially formed therein and opening in a lower end face thereof, in which is accommodated a nozzle spring 12 in the form of a coiled spring. The nozzle spring 12 has its lower end supported by the movable spring seat 10 and its upper end supported by a stationary spring seat 14 disposed in contact with an upper end wall of the spring chamber 13. The spring chamber 13 is a closed type which has no fuel drain passage communicating with a zone under a lower pressure. An axial bore 19 is formed in an upper portion of the nozzle holder 1 along its axis, which upwardly extends from the spring chamber 13 and opens into a fuel inlet port 23 axially aligned with the axial bore 19, hereinafter referred to. Slidably fitted in the axial bore 19 is a central plunger 15 which is displaceable in unison with the nozzle needle 6. An orifice 27 as restriction means is formed integrally with an inner peripheral surface of an upper end portion of the axial bore 19 at a location between the fuel inlet port 23 and an upper end of the central plunger 15. An upper end face 16 of the central plunger 15 having a predetermined cross section is disposed in the axial bore 19 to act as a pressure-receiving surface. An upper end portion of the central plunger 15 is fitted in the axial bore 19 located below the orifice 27 in an oiltight manner for displacement therein, while an intermediate and lower portion of the central plunger 15 extends through a central through hole 21 formed in the stationary spring seat 14 and is located in the spring chamber 13 within the nozzle holder 1. A lower end portion of the central plunger 15 is formed integrally with another movable spring seat 18 in the form of a collar, which is located radially inwardly of the nozzle spring 12. A return spring 22 in the form of a coiled spring is supported at its lower end by the movable spring seat 18 and at its upper end by the stationary spring seat 14, and thus acts to bias the central plunger 15 to its extreme lowermost position. The central plunger 15 has its lower end face permanently kept in contact with an upper end face of the movable spring seat 10 on top of the nozzle needle 6 by the force of the return spring 22 for movement in unison with the nozzle needle 6 during the lifting stroke thereof. An upper end face **6*a* of the nozzle needle 6 is disposed opposite a lower end face 2*a* of the distance piece 2 with a predetermined gap L therebetween which determines the whole injection lifting stroke of the nozzle needle 6. Thus, the central plunger 15 in contact with the nozzle needle 6 via the movable spring seat 10 starts to lift in unison with the nozzle needle 6 simultaneously when the nozzle needle 6 starts to lift, to execute the injection lifting stroke L. The fuel inlet port 23 communicating with the axial bore 19, is to be connected to an injection pipe 50 extending from a fuel injection pump 40 to be supplied with pressurized fuel therefrom, and thus has an internal pressure equal to the pressure within the injection pipe 50**.

Fuel passages 24, 25, and 26 are continuously formed, respectively, in the nozzle holder 1, the distance piece 2, and the nozzle body 3 to connect between the fuel inlet port 23 and the pressure chamber 8, as a fuel supply passageway.

The operation of the fuel injection valve constructed as above will now be explained. Pressurized fuel delivered from the fuel injection pump 40 through the injection pipe 50 is guided through the fuel inlet port 23 and the fuel passages 24, 25 and 26 into the pressure chamber 8, and also guided through the fuel inlet port 23 into the axial bore 19. As the pressure chamber 8 is supplied with the pressurized fuel, its internal pressure increases to urgingly act upon the nozzle needle 6. When the pressure within the pressure chamber 8 increases up to a value exceeding the sum of the setting load of the nozzle spring 12 and the pressure within a portion of the axial bore 19 located below the orifice 27 acting upon the pressure-receiving surface 16 of the central plunger 15 in contact with the nozzle needle 6 via the movable spring seat 10, the nozzle needle 6 starts to lift together with the central plunger 15 for injection of fuel through the nozzle holes 7. As the central plunger 15 lifts in unison with the nozzle needle 6, the fuel within the axial bore 19 starts to escape therefrom into the fuel inlet port 23 through the orifice 27. On this occasion, by virtue of the action of the orifice 27, the flow rate of the fuel within the portion of axial bore 19 into the fuel inlet port 23 is restricted, thereby increasing the pressure within the portion of the axial bore 19 located below the orifice 27. Thus, a high valve opening pressure is obtained, and at the same time, a gradual lifting motion of the nozzle needle 6 is achieved. That is, as indicated by the one dot chain line in FIG. 2, the nozzle needle 6 gradually or slowly lifts at the start of the injection, so that the nozzle holes 7 are gradually opened and accordingly the fuel injection quantity is gradually increased. Therefore, the flow rate through the nozzle holes 7 can be throttled over a sufficient period of time, that is, a long throttling period is obtained, thereby reducing the fuel injection quantity supplied to the engine during a lag period between the start of the injection and firing within the engine cylinder, and accordingly reducing the combustion noise of the engine to a great extent.

The fuel injection terminates when the nozzle needle 6 returns to its initial seated position after completing the whole lifting stroke L. Upon termination of the fuel injection when the pressure delivery of the fuel injection pump 40 terminates, there occurs a temporary drop in the injection pipe pressure. A corresponding pressure drop takes place in the fuel inlet port 23 in advance of a corresponding pressure drop in the pressure chamber 8 at the termination of fuel injection. In addition, the pressure within the axial bore 19 is further diminished below the pressure within the fuel inlet port 23 through the orifice 27 to act upon the pressure-receiving surface 16 of the central plunger 15. Therefore, the central plunger 15 and the nozzle needle 6 become detached from each other, and they separately and simultaneously descend. Accordingly, the nozzle needle 6 is acted upon by a smaller force in the closing direction during the returning stroke than during the injection stroke. As a consequence, the nozzle needle 6 is struck against its seat by a weak force nearly equal to that of a conventional fuel injection valve having a low valve opening pressure with a small setting load of its nozzle spring. Thus, a low valve closing pressure is obtained, and breakage of the tip portion of the nozzle body 3 formed with the nozzle holes 7 is avoided, which would be otherwise caused by the nozzle needle 6 being struck against its seat by a large force.

Figure 2:
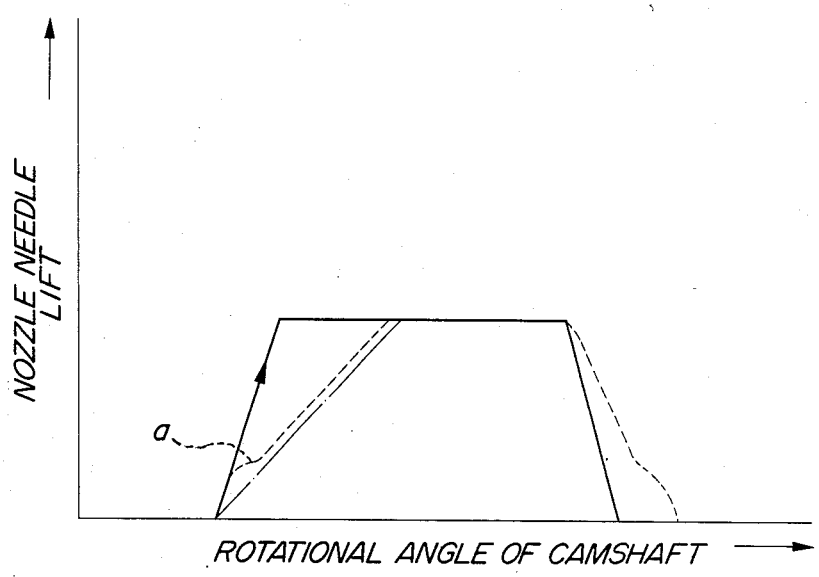
FIG. 2 is a graph showing waveforms indicative of the lift of the nozzle needle relative to the rotational angle of the camshaft of an associated fuel injection pump, obtained with a conventional fuel injection valve and one according to the present invention.

Further, at the termination of injection, the central plunger 15 immediately moves back downward, as viewed in FIG. 1, in a direction away from the fuel inlet port 23 to cancel a decrease in the volume of the effective fuel space which would otherwise be caused by descending of the nozzle needle 6, thereby obtaining a sharply cut trailing edge of the waveform as shown by the solid line in FIG. 2. Therefore, the fuel injection valve according to the invention can achieve an ideal injection rate waveform and contribute to improving the emission characteristics of the engine.

Although in the foregoing embodiment, the spring chamber 13 is a closed type which has no fuel drain passage communicating with a zone under a lower pressure, this is not limitative, but a spring chamber having such fuel drain passage may alternatively be employed, with substantially identical results.

While a preferred embodiment of the invention has been described, variations thereto will occur to those skilled in the art within the scope of the present inventive concepts which are delineated by the following claims.

What is claimed is:

1. A fuel injection valve for an internal combustion engine, comprising: a nozzle holder having a fuel inlet port formed therein and connected to an injection pipe extending from a fuel injection pump; a nozzle body supported by said nozzle holder and having at least one nozzle hole and a pressure chamber formed therein at an end thereof remote from said nozzle holder, said pressure chamber being more remote from said injection pipe than said fuel inlet port; fuel passage means formed in said nozzle holder and said nozzle body and extending between said fuel inlet port and said pressure chamber; a nozzle needle mounted within said nozzle body and liftable and returnable to open and close said nozzle hole, respectively, in response to an increase and a decrease in the pressure of fuel supplied into said pressure chamber; nozzle spring means urging said nozzle needle in a direction of closing said nozzle hole; a central plunger disposed in said nozzle holder for displacement in unison with said nozzle needle through a whole lifting stroke thereof, said central plunger having one end remote from said nozzle needle, said one end having an end face thereof disposed to receive pressure within said injection pipe through said fuel inlet port to thereby impart an urging force to said nozzle needle in said direction of closing said nozzle hole; said nozzle holder having an axial bore formed therein and communicating with said fuel inlet port, said axial bore slidably receiving therein said one end of said central plunger remote from said nozzle needle; and restriction means provided in said axial bore at a location between said fuel inlet port and said one end of said central plunger remote from said nozzle needle above a maximum lifted position of said central plunger, said restriction means at least restricting flowing within said axial bore therefrom into said fuel inlet port as said central plunger lifts in unison with said nozzle needle, whereby said nozzle needle gradually lifts.

2. A fuel injection valve as claimed in claim 1, wherein said restriction means comprises an orifice formed in an inner peripheral surface of said axial bore.

3. A fuel injection valve as claimed in claim 1, including a movable spring seat interposed between said nozzle needle and said central plunger and supporting said nozzle spring means, said movable spring seat being supported by said nozzle needle and supporting said central plunger in a manner such that said central plunger has another end disposed in contact with an end face of said movable spring seat remote from said nozzle needle.

4. A fuel injection valve as claimed in claim 1, including a return spring urging said central plunger toward said nozzle needle.

5. A fuel injection valve as claimed in claim 1, further including a narrow space interposed between said pressure chamber and said at least one nozzle hole and communicating therebetween, and wherein said nozzle needle is disposed to have a tip seated in said narrow space thereby closing said at least one nozzle hole.

* * * * *